US009376875B2

(12) United States Patent
Reitsma et al.

(10) Patent No.: US 9,376,875 B2
(45) Date of Patent: Jun. 28, 2016

(54) WELLBORE ANNULAR PRESSURE CONTROL SYSTEM AND METHOD USING GAS LIFT IN DRILLING FLUID RETURN LINE

(71) Applicant: Smith International, Inc., Houston, TX (US)

(72) Inventors: Donald D. Reitsma, Katy, TX (US); Ossama R. Sehsah, Katy, TX (US); Yawan Couturier, Katy, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 0 days.

(21) Appl. No.: 14/396,577

(22) PCT Filed: Apr. 29, 2013

(86) PCT No.: PCT/US2013/038615

§ 371 (c)(1),
(2) Date: Oct. 23, 2014

(87) PCT Pub. No.: WO2013/163642

PCT Pub. Date: Oct. 31, 2013

(65) Prior Publication Data

US 2015/0083429 A1 Mar. 26, 2015

Related U.S. Application Data

(60) Provisional application No. 61/639,815, filed on Apr. 27, 2012.

(51) Int. Cl.
*E21B 21/08* (2006.01)
*E21B 21/00* (2006.01)

(Continued)

(52) U.S. Cl.
CPC ..... *E21B 21/08* (2013.01); *E21B 17/01* (2013.01); *E21B 21/001* (2013.01); *E21B 21/06* (2013.01);

(Continued)

(58) Field of Classification Search
CPC ..... E21B 21/08; E21B 44/00; E21B 21/103; E21B 21/001; E21B 47/06; E21B 21/16; E21B 17/01; E21B 47/12; E21B 21/06
See application file for complete search history.

(56) References Cited

U.S. PATENT DOCUMENTS 4,091,881 A * 5/1978 Maus ..... 175/7
6,904,891 B2 6/2005 Tominaga et al.

(Continued)

OTHER PUBLICATIONS

International Search Report and Written Opinion of PCT Application Serial No. PCT/US2013/038615 dated Jul. 24, 2013 (11 pages).

(Continued)

*Primary Examiner* — James G Sayre

(57) ABSTRACT

A system and method include pumping drilling fluid through a drill string extended into a wellbore extending below the bottom of a body of water, out the bottom of the drill string and into the wellbore annulus. Fluid is discharged from the annulus into a riser and a discharge conduit. The riser is disposed above the top of the wellbore and extends to the water surface. The discharge conduit couples to the riser and includes a controllable fluid choke. A fluid return line is coupled to an outlet of the choke and extends to the water surface. Gas under pressure is pumped into the return line at a selected depth below the water surface. The controllable fluid choke may be operated to maintain a selected drilling fluid level in the riser, the selected fluid level being a selected distance below the water surface.

17 Claims, 5 Drawing Sheets

(51) Int. Cl.

| | |
|---|---|
| ***E21B 21/16*** | (2006.01) |
| ***E21B 44/00*** | (2006.01) |
| ***E21B 47/12*** | (2012.01) |
| ***E21B 21/10*** | (2006.01) |
| ***E21B 17/01*** | (2006.01) |
| ***E21B 47/06*** | (2012.01) |
| ***E21B 21/06*** | (2006.01) |

(52) U.S. Cl.
CPC ..... *E21B 21/103* (2013.01); *E21B 21/16* (2013.01); *E21B 44/00* (2013.01); *E21B 47/06* (2013.01); *E21B 47/12* (2013.01)

(56) References Cited

U.S. PATENT DOCUMENTS

| | | | | |
|---|---|---|---|---|
| 7,806,203 | B2 | 10/2010 | Krueger et al. | |
| 8,453,758 | B2 * | 6/2013 | Horton et al. | 175/5 |
| 8,490,719 | B2 * | 7/2013 | Duhe et al. | 175/57 |
| 2003/0196804 | A1 | 10/2003 | Riet | |
| 2004/0124008 | A1 * | 7/2004 | Fincher et al. | 175/5 |
| 2005/0092523 | A1 * | 5/2005 | McCaskill et al. | 175/38 |
| 2006/0065402 | A9 * | 3/2006 | Fontana et al. | 166/358 |
| 2006/0191716 | A1 * | 8/2006 | Humphreys | 175/5 |
| 2008/0060846 | A1 * | 3/2008 | Belcher | E21B 17/042 175/25 |
| 2008/0105434 | A1 * | 5/2008 | Orbell et al. | 166/356 |
| 2008/0296062 | A1 | 12/2008 | Horton, III et al. | |
| 2010/0186960 | A1 | 7/2010 | Reitsma et al. | |
| 2010/0288507 | A1 | 11/2010 | Duhe et al. | |
| 2011/0125333 | A1 * | 5/2011 | Gray | 700/282 |
| 2011/0139464 | A1 | 6/2011 | Henderson et al. | |
| 2012/0285698 | A1 | 11/2012 | Horton, III et al. | |

OTHER PUBLICATIONS

Search Report issued in AU application 2013251321 on Jul. 27, 2015, 3 pages.
Search Report issued in CA application 2871620 on Sep. 1, 2015, 5 pages.

* cited by examiner

WELLBORE ANNULAR PRESSURE CONTROL SYSTEM AND METHOD USING GAS LIFT IN DRILLING FLUID RETURN LINE

BACKGROUND

The exploration and production of hydrocarbons from subsurface formations include systems and methods for extracting the hydrocarbons from the formation. A drilling rig may be positioned on land or a body of water to support a drill string extending down into a wellbore. The drill string may include a bottom hole assembly made up of a drill bit and sensors, as well as a telemetry system capable of receiving and transmitting sensor data. Sensors disposed in the bottom hole assembly may include pressure and temperature sensors. A surface telemetry system is included for receiving telemetry data from the bottom hole assembly sensors and for transmitting commands and data to the bottom hole assembly.

Fluid "drilling mud" is pumped from the drilling platform, through the drill string, and to a drill bit supported at the lower or distal end of the drill string. The drilling mud lubricates the drill bit and carries away well cuttings generated by the drill bit as it digs deeper. The cuttings are carried in a return flow stream of drilling mud through the well annulus and back to the well drilling platform at the earth's surface. When the drilling mud reaches the platform, it is contaminated with small pieces of shale and rock that are known in the industry as well cuttings or drill cuttings. Once the drill cuttings, drilling mud, and other waste reach the platform, separation equipment is used to remove the drill cuttings from the drilling mud, so that the drilling mud may be reused.

A fluid back pressure system may be connected to a fluid discharge conduit to selectively control fluid discharge to maintain a selected pressure at the bottom of the borehole. Fluid may be pumped down the drilling fluid return system to maintain annulus pressure during times when the mud pumps are turned off. A pressure monitoring system may also be used to monitor detected borehole pressures, model expected borehole pressures for further drilling, and to control the fluid backpressure system.

DETAILED DESCRIPTION

Figure 1:
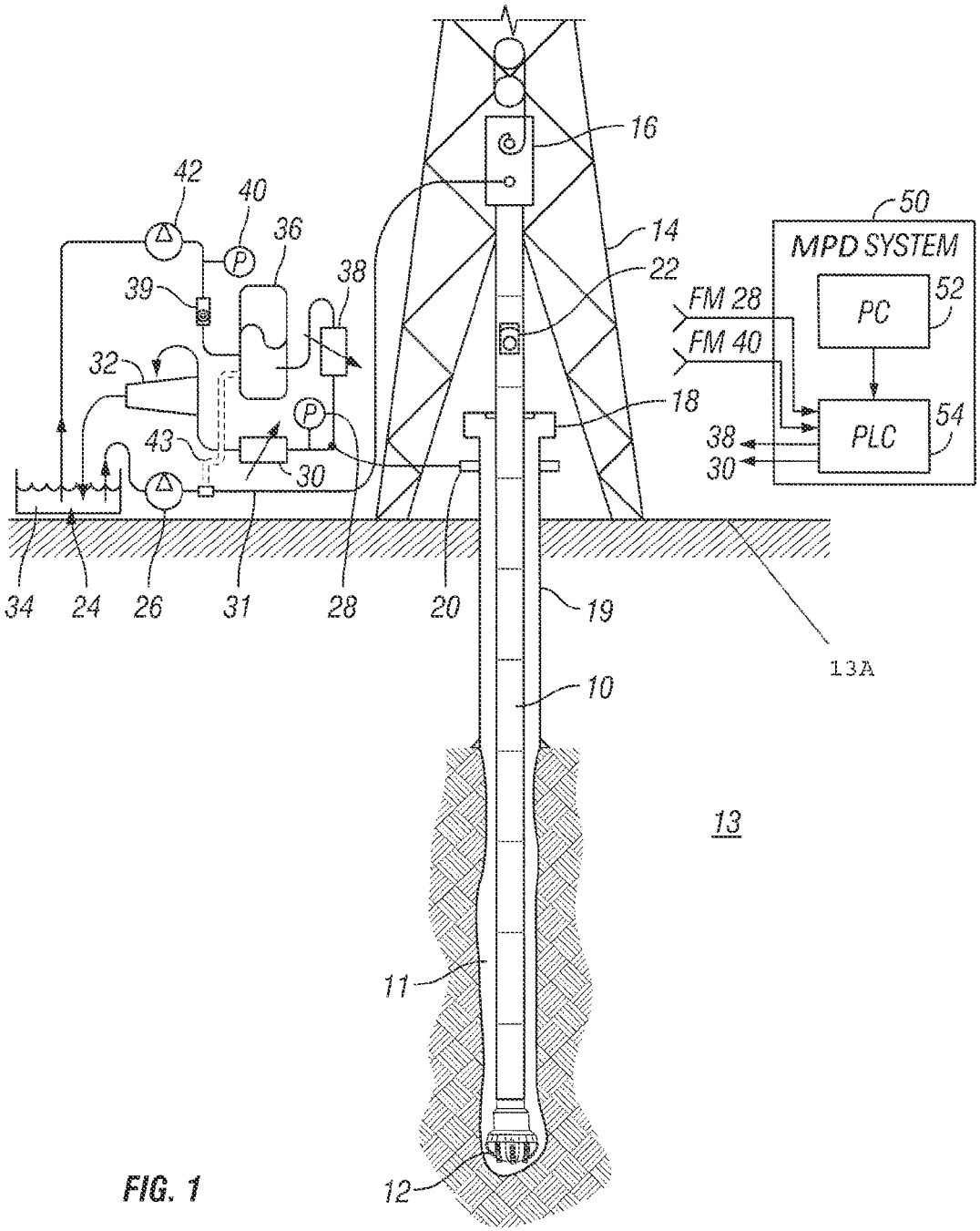
FIG. 1 shows a drilling system including an example managed pressure drilling system.

Embodiments disclosed herein relate to a system that includes, according to one aspect, a drill string extending into a wellbore below a bottom of a body of water, a primary pump for selectively pumping a drilling fluid through the drill string and into an annular space created between the drill string and the wellbore, a riser extending from a top of the wellbore to a platform on a surface of the body of water, a fluid discharge conduit in fluid communication with the riser, a controllable orifice choke coupled to the discharge conduit, a fluid return line extending from the choke to the platform, and a source of compressed gas coupled to the fluid return line at a selected depth below the surface of the body of water.

In some embodiments, a pressure sensor may be coupled to a discharge conduit proximate the choke and/or at a selected depth in the wellbore or the riser. The system may further include a controller that accepts an input signal from the pressure sensor and generates an output signal to operate the choke. The choke is operated to maintain a selected hydrostatic pressure in the riser at a selected distance below the water surface.

In accordance with certain embodiments disclosed herein, a system as described may be used for controlling wellbore annulus pressure during the drilling of a marine subterranean formation, i.e., a formation disposed below a body of water. Embodiments disclosed herein may also relate to a method for controlling wellbore annulus pressure during the drilling of a marine subterranean formation.

In one aspect, a method in accordance with embodiments disclosed herein includes pumping drilling fluid through a drill string extended into a wellbore extending below a bottom of a body of water, out the bottom of the drill string, and into the wellbore annulus, discharging fluid from the wellbore annulus and into a riser disposed above the top of the wellbore, the riser extending to the surface of the body of water, discharging fluid from the riser into a discharge conduit disposed below the surface of the body of water, the discharge conduit including therein a controllable fluid choke, a fluid return line coupled to an outlet of the choke and extending to the surface of the body of water, pumping gas under pressure into the return line at a selected depth below the surface of the body of water, and operating the controllable fluid choke to maintain a selected hydrostatic pressure in the riser at a selected distance below the surface of the body of water.

In another aspect, a method in accordance with embodiments disclosed herein includes pumping drilling fluid through a drill string extended into a wellbore extending below the bottom of a body of water, out the bottom of the drill string, and into the wellbore annulus, discharging fluid from the wellbore annulus into a riser disposed above the top of the wellbore and into a discharge conduit, the discharge conduit including a fluid choke and a fluid return line coupled to an outlet of the fluid choke and extending to the water surface, pumping gas under pressure into the return line at a selected depth below the water surface, and controlling a rate at which the gas is pumped into the return line to maintain a level of fluid in the riser at a selected distance below the surface of the body of water.

A drilling system including an example managed pressure drilling is shown schematically in FIG. 1. One example of a manage pressure drilling system is a dynamic annular pressure control (DAPC) system, as described in U.S. Pat. No. 6,904,981 issued to van Riet and incorporated herein by reference in its entirety. A drilling unit 14 (a "rig" drilling unit is shown in FIG. 1) or similar hoisting device suspends a drill string 10 in a wellbore 11 being drilled through subsurface rock formations 13. A drill bit 12 is coupled to the lower end of the drill string 10, and is rotated by the drill string 10. Drill string rotation may be enabled either by a hydraulic motor or turbine (not shown) coupled in the drill string 10 or by equipment such as a top drive 16 suspended in the drilling unit 14. Application of some of the weight of the drill string 10 to the bit 12 and the rotation imparted to the bit 12 cause the bit 12 to drill through the formations 13, thereby extending the length of the wellbore 11. The drilling unit 14 is shown supported on the land surface 13A; however, the drilling unit 14 including some or all of the components described in FIG.

1 may be used in marine drilling and may be disposed on a platform on the water surface. Such will be explained below with reference to FIG. 2.

In the embodiment shown in FIG. 1, a primary pump ("mud pumps") 26 at the Earth's surface lifts drilling fluid ("mud") 34 from a tank 24 and discharges the mud 34 under pressure through a standpipe and flexible hose 31 to the top drive 16. In other embodiments, mud may be drawn from a pit or other type of reservoir. The top drive 16 includes internal rotary seals to enable the mud 34 to move through the top drive 16 to an internal conduit (not shown) in the interior of the drill string 10. The drill string 10 may include a check valve 22 or similar device to prevent reverse movement of the mud 34 during times when the mud pumps 26 are not activated, and/or when the top drive 16 is disconnected from the upper end of the drill string 10, e.g., during "connections" (adding or removing segments of pipe from the drill string 10).

As the mud 34 travels through the drill string 10, it is eventually discharged from nozzles or courses (not shown separately) in the drill bit 12. Upon leaving the drill bit 12, the mud 34 enters the annular space between the exterior of the drill string 10 and the wall of the wellbore 11. The mud 34 lifts drill cuttings from the wellbore 11 as it travels back to the land surface 13A.

Discharge of the mud 34 from the annular space may be controlled by a back pressure system. The back pressure system may include rotating control head (or rotating blowout preventer) 18 coupled to the upper end of a surface pipe or casing 19. The rotating control head 18 seals against the drill string 10, thereby preventing discharge of fluid from the wellbore except through a discharge line 20. The casing 19 is typically cemented into the upper part of the wellbore 11. Mud 34 leaves the annular space through the discharge line 20. The discharge line 20 may be coupled at one end to the rotating control head 18 and coupled at its other end to a discharge line choke, i.e., a controllable orifice choke, 30 that selectively controls the pressure at which the mud 34 leaves the discharge line 20. After leaving the discharge line choke 30, the mud 34 may be discharged into cleaning devices, shown collectively at 32, such as a degasser to remove entrained gas from the mud 34 and/or a "shale shaker" to remove solid particles from the mud 34. After leaving the cleaning devices 32, the mud 34 is returned to the tank 24. Operation of the choke 30 may be related to measurements made by a pressure sensor 28 in hydraulic communication with the discharge line 20.

The back pressure system may also include a back pressure pump 42 which may lift mud from the tank 24. The back pressure pump 42 may be smaller, with respect to pumping capacity, than the primary pump 26. The discharge side of the back pressure pump 42 may be hydraulically coupled to an accumulator 36. A check valve 39 may be included in the foregoing connection to prevent the mud under pressure in the accumulator 36 from flowing back through the back pressure pump 42, e.g., when the back pressure pump 42 is not activated. A pressure sensor 40 may be included in the foregoing connection to automatically switch the back pressure pump 42 off when the accumulator 36 is charged to a predetermined pressure. The accumulator 36 is also hydraulically connected to the discharge line 20 through a controllable orifice choke, e.g., accumulator choke 38 (which may be substituted by or include a valve).

During operation of such back pressure system, the back pressure pump 42 operates to charge the accumulator 36. As fluid volume is needed to maintain back pressure in the discharge line 20, the accumulator choke 38 may be operated to enable flow from the accumulator 36 to the discharge line 20. Concurrently, the discharge line choke 30 may be operated to substantially or entirely stop flow of mud 34.

In other examples, the back pressure pump 42 may be omitted, and some of the discharge from the mud pumps 26 may be used to charge the accumulator. One example is shown by the dotted line 43 in FIG. 1, which indicates the fluid coupling of some of the fluid output from mud pumps 26 to the accumulator 36.

The accumulator 36 may be any type known in the art, for example, types having a movable seal, diaphragm or piston to separate the accumulator 36 into two pressure chambers. Some accumulators can have the side of the diaphragm or piston opposite the fluid charged side pre-pressurized to a selected pressure, such as with compressed gas, and/or with a spring or other biasing device to provide a selected force to the diaphragm or piston. In other accumulators, the opposite side of the accumulator 36 may be charged with fluid under pressure using a separate fluid pump (not shown). In such accumulators, the back pressure exerted by the accumulator 36 may be changed by using the separate fluid pump, rather than by using a selected pressure to provide a selected force (e.g., by using compressed gas and/or a spring). The accumulator charge pressure may be increased under circumstances when it is necessary to discharge drilling fluid into the annulus to increase pressure. The charge pressure in the accumulator 36 may be relieved, for example, when the primary pumps 26 are restarted, or when the back pressure pump 42 is started.

In the example of FIG. 1, the backpressure control system may be operated automatically by a managed pressure drilling ("MPD") system 50. The MPD system 50 may include an operator control, such as a PC or touch screen 52, and programmable logic controller (PLC) 54. The PLC 54 may accept, as input, signals from various pressure sensors, including but not limited to pressure sensors 28 and 40 in FIG. 1. The PLC 52 may also operate the variable, controllable orifice chokes 38, 30, as well as the backpressure pump 42. As explained in the van Riet '981 Patent referenced above, the MPD system 50 may operate the various system components to maintain a selected fluid pressure in the discharge line 20, and thus within the annular space between the sidewall of wellbore 11 and the drill string 10, and more specifically, at a selected pressure at the bottom of the wellbore 11.

The example drilling system including the MPD system 50 explained with reference to FIG. 1 is intended to explain the principles of MPD systems, and is not intended to limit the scope of such systems or the components actually used in any particular example of marine drilling, as will be explained with reference to FIG. 2.

Figure 2:
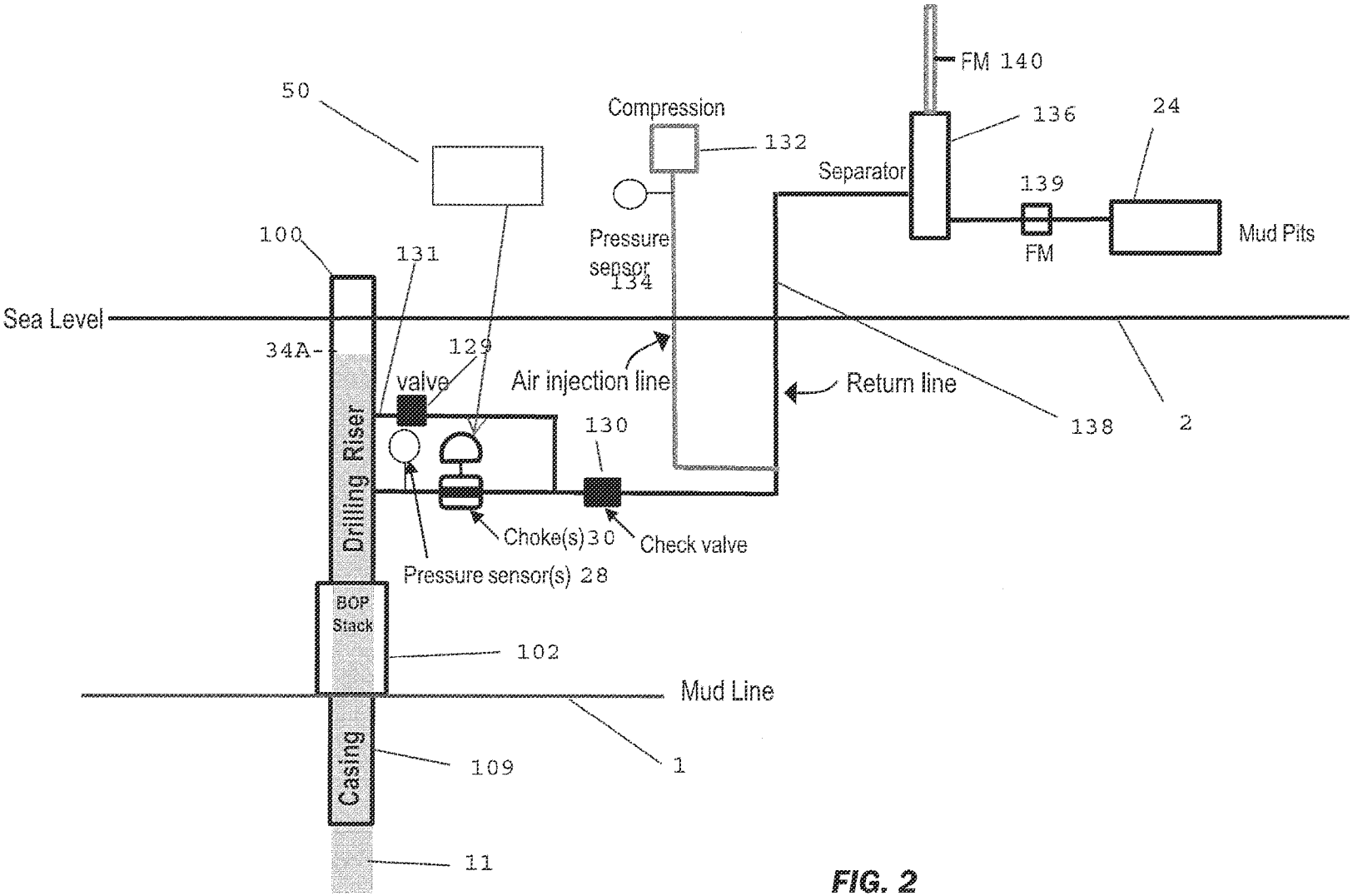
FIG. 2 shows an example managed pressure drilling system as in FIG. 1 used in connection with a drilling fluid return line carrying a gas-lifted drilling fluid in accordance with embodiments disclosed herein.

FIG. 2 shows another example MPD system that may be used in marine drilling, wherein a set of wellbore flow control valves (blowout preventer stack or "BOP") 102 may be disposed at the top of the wellbore 11 proximate the bottom of a body of water or "mud line" 1. Drilling the wellbore 11 and circulation of drilling mud (34 in FIG. 1) may be performed by components similar to those shown in and explained with reference to FIG. 1 above and FIGS. 3-5 below, but in the present example such components may be disposed on a platform (not shown) disposed on the water surface 2. Some of the foregoing components are omitted from FIG. 2 for clarity of the illustration. A riser 100 may extend from the BOP 102 to the platform (not shown for clarity of the illustration) at the water surface 2. A casing 109 may extend below the mud line 1 to a selected depth in the wellbore 11. The BOP 102 may be coupled to the upper end portion of the casing. As shown, the choke 30, e.g., a controllable orifice choke, is coupled to the drilling riser 100 at a selected depth below the water surface 2. The remainder of wellbore drilling operations may be performed substantially as explained with reference to FIG. 1.

A MPD system 50, configured as explained with reference to FIG. 1, may be disposed on the platform (not shown). The MPD system may accept an input signal from various pressure sensors and/or flow meters, for example, pressure sensor 28 fluidly connected to riser 100 and/or flow meters 139, 140 fluidly connected to a return line 138. An output signal from the MPD system 50 may control the opening of controllable, adjustable orifice choke 30. In the present example, fluid input to the choke 30 may be obtained from a line hydraulically connected to the riser 100, e.g., a discharge conduit, at a selected elevation above the BOP 102. While shown as being connected to riser 100, in one or more other embodiments, the discharge conduit may be connected to the wellhead or directly to the annular space, e.g., below riser 100. Fluid output from choke 30 may be coupled through a check valve 130 to a fluid return line 138. A bypass valve 129 may be hydraulically connected to the riser 100 via a bypass conduit 131 and to a point downstream of the choke 30. In the present example, the wellbore 11 may be open to the riser 102, and drilling may be performed without the use of a rotating control head or rotating diverter as shown in FIG. 1.

In the present example, the fluid return line 138 may be maintained at a lower hydrostatic pressure (and gradient thereof) than that which would be exerted by a column of the drilling fluid (mud 34 in FIG. 1) extending the vertical distance traversed by the fluid return line 138. As shown, the fluid return line 138 extends from the choke 30 to the drilling platform (not shown), such that at least a vertical portion of the fluid return line 138 is disposed below the water surface 2. The lower hydrostatic pressure (and gradient thereof) of the fluid return line 138 is maintained by coupling the output of a gas compressor 132 to the return line 138 at a selected depth below the water surface 2. As shown, the output of the gas compressor 132 may be coupled to the vertical portion of the fluid return line 138 at the selected depth below the water surface 2. The gas compressor 132 may provide gas, air, nitrogen or other substantially inert gas ("gas") under pressure through such coupling to the fluid return line 138.

Coarse control may be obtained by operating the gas compressor 132 at a substantially constant rate or at a rate corresponding to a rate at which the drilling unit mud pump(s) (26 in FIG. 1) operate. The fluid return line 138 may be coupled to a gas/liquid separator 136 disposed on the drilling platform (not shown). One of ordinary skill in the art will appreciate that any gas/liquid separator 136 may be used in accordance with embodiments disclosed herein, such as, for example, a mechanical degasser or a centrifuge. A flow meter 139 coupled to a liquid discharge end of the gas/liquid separator 136 may measure the liquid mud flow rate exiting the separator 136 before returning the liquid mud to the tank 24. Gas flow rate out of the separator 136 may be measured by a flowmeter 140 coupled to a gas discharge end of the gas/liquid separator 136 to help verify that the amount of gas entering the return line 138 is substantially the same as that leaving the gas/liquid separator 136. Such comparison may assist in, for example, determining if gas is entering the wellbore 11 from a subsurface formation or if a leak in the system is present.

In the present example, the lower hydrostatic pressure of the fluid column in the fluid return line 138 may cause the choke 30 to operate with a lower downstream pressure than would be the case if the fluid return line was only filled with a drilling mud column, e.g., having a hydrostatic pressure with only the mud pumped into the wellbore 11. In this way, the choke 30 may be operated so that a mud level 34A in the riser 100 may be maintained at a selected distance below the water surface 2, thereby exerting a lower hydrostatic pressure in the wellbore 11 than would be exerted by a column of drilling mud in the riser 100 extending to the water surface 2. In the present example, pressure signals from the pressure sensor 28, and the flow meters 140, 139 may be used by the MPD system 50 (or a stroke counter may be used in connection with the rig pumps (26 in FIG. 1)) to operate the choke 30 to maintain a selected hydrostatic pressure in the riser 100 above the measurement point which would correspond to a fluid level 34A in the riser 100. For example, PLC 54 (FIG. 1) may receive signals from the pressure sensor 28, flow meters 140, 139, and/or other sensors and generate an output signal to operate the variable, controllable orifice chokes 38, 30, as well as the backpressure pump 42 to maintain fluid pressure in the wellbore at a selected value. Such operation of a MPD system may be substantially as set forth in U.S. Pat. No. 6,904,981 issued to van Riet, as discussed in more detail below. One of ordinary skill in the art will appreciate that other sensors may be disposed at various locations within the system, for example, a pressure sensor may be disposed on a vertical portion of the return line 138, a gas injection line, shown at 134, or other locations within the system as needed.

While the example explained above with reference to FIG. 2 may use a MPD system 50 to control the choke 30 to maintain a selected hydrostatic pressure, e.g., in the riser, in some examples, the choke 30 may be operated without a MPD system 50. The choke 30 may be operated manually or automatically to maintain a selected hydrostatic pressure as sensed or measured by sensor 28. Accordingly, the scope of the present disclosure is not limited to using a MPD system 50. In some examples, the choke 30 may be a fixed orifice choke and hydrostatic pressure in the riser 100 may be maintained by controlling a rate at which gas is pumped into the fluid return line 138.

Figure 3:
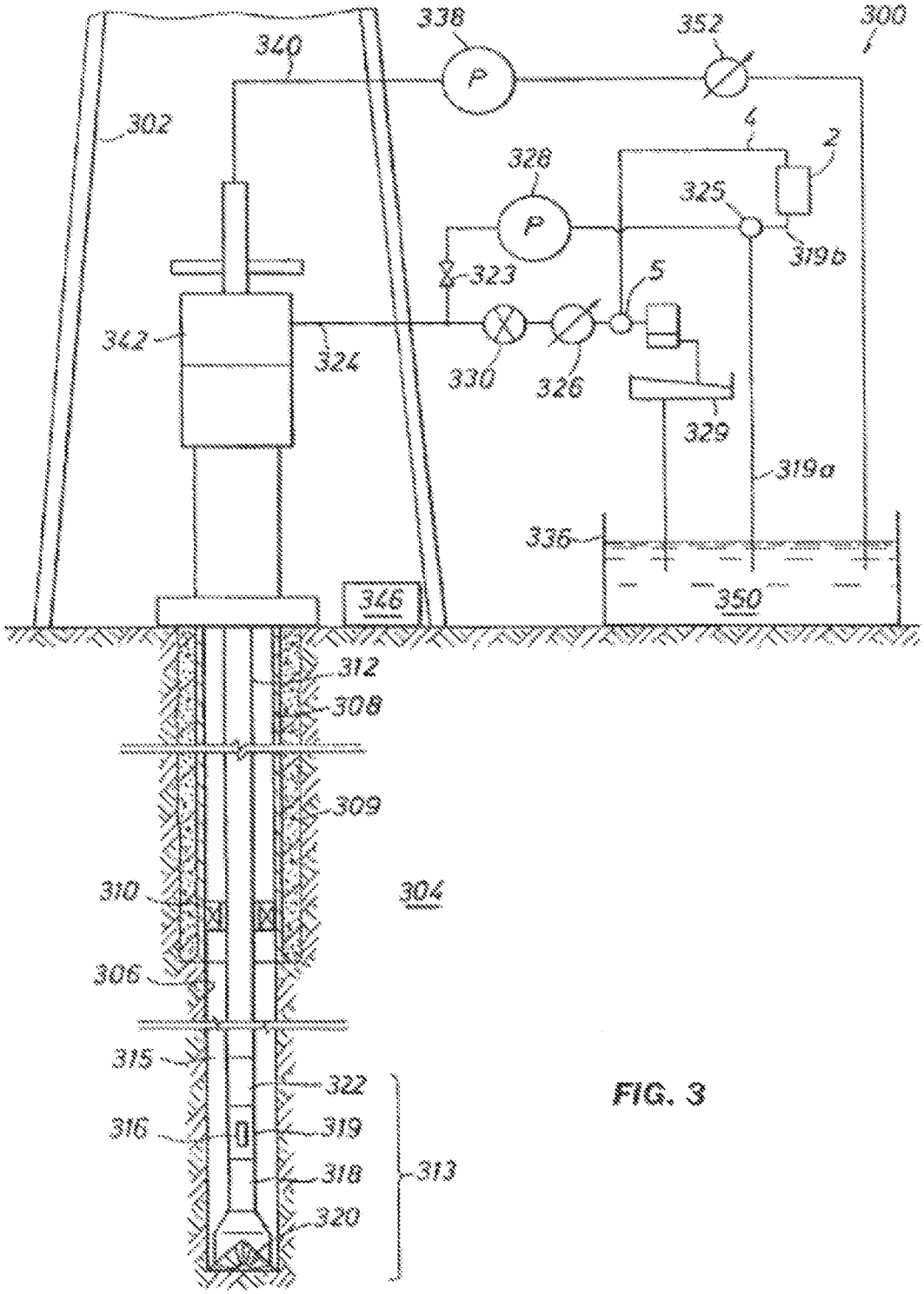
FIGS. 3-5 show examples of managed pressure drilling systems used in accordance with embodiments disclosed herein.
Figure 4:
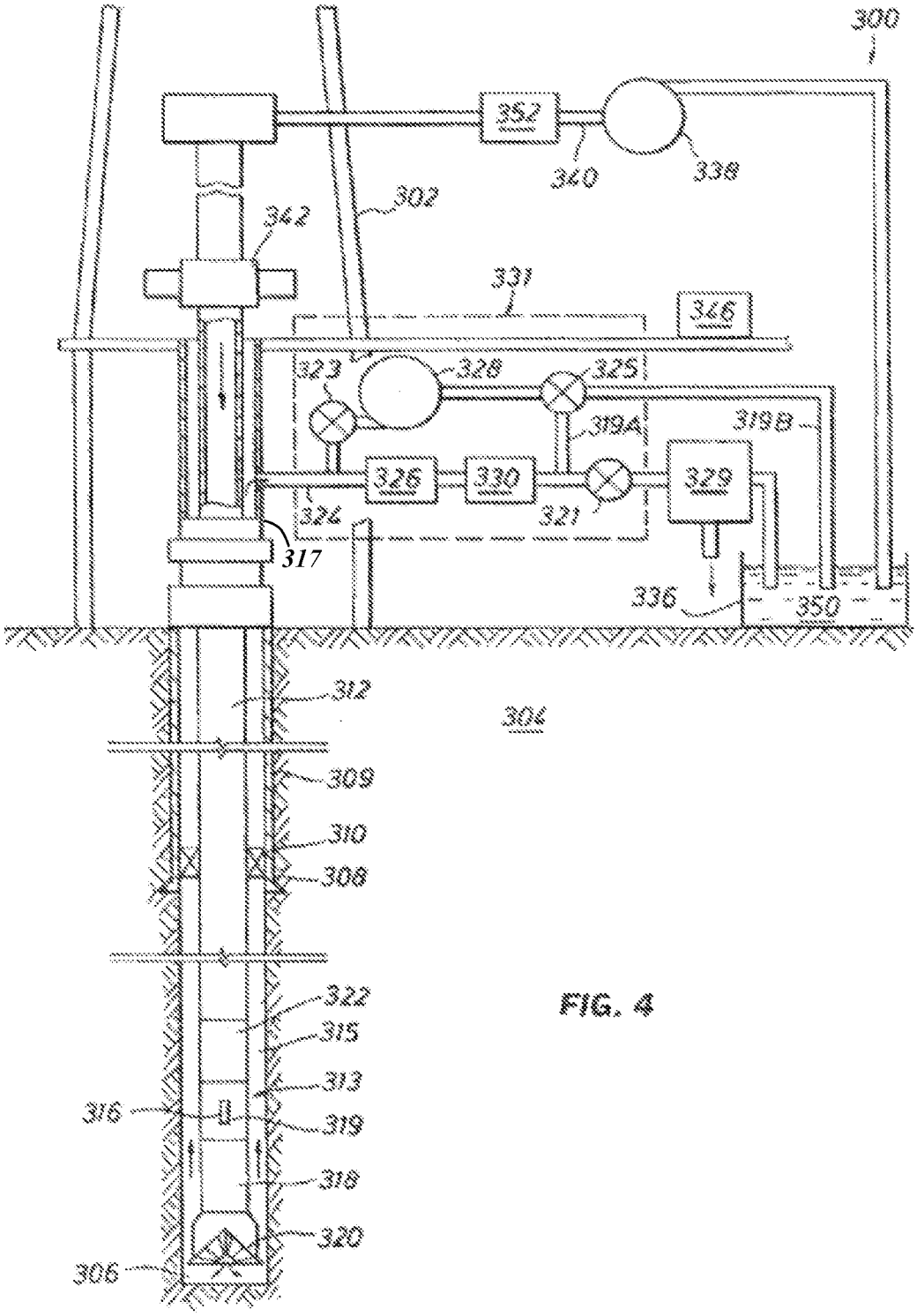
Figure 5:
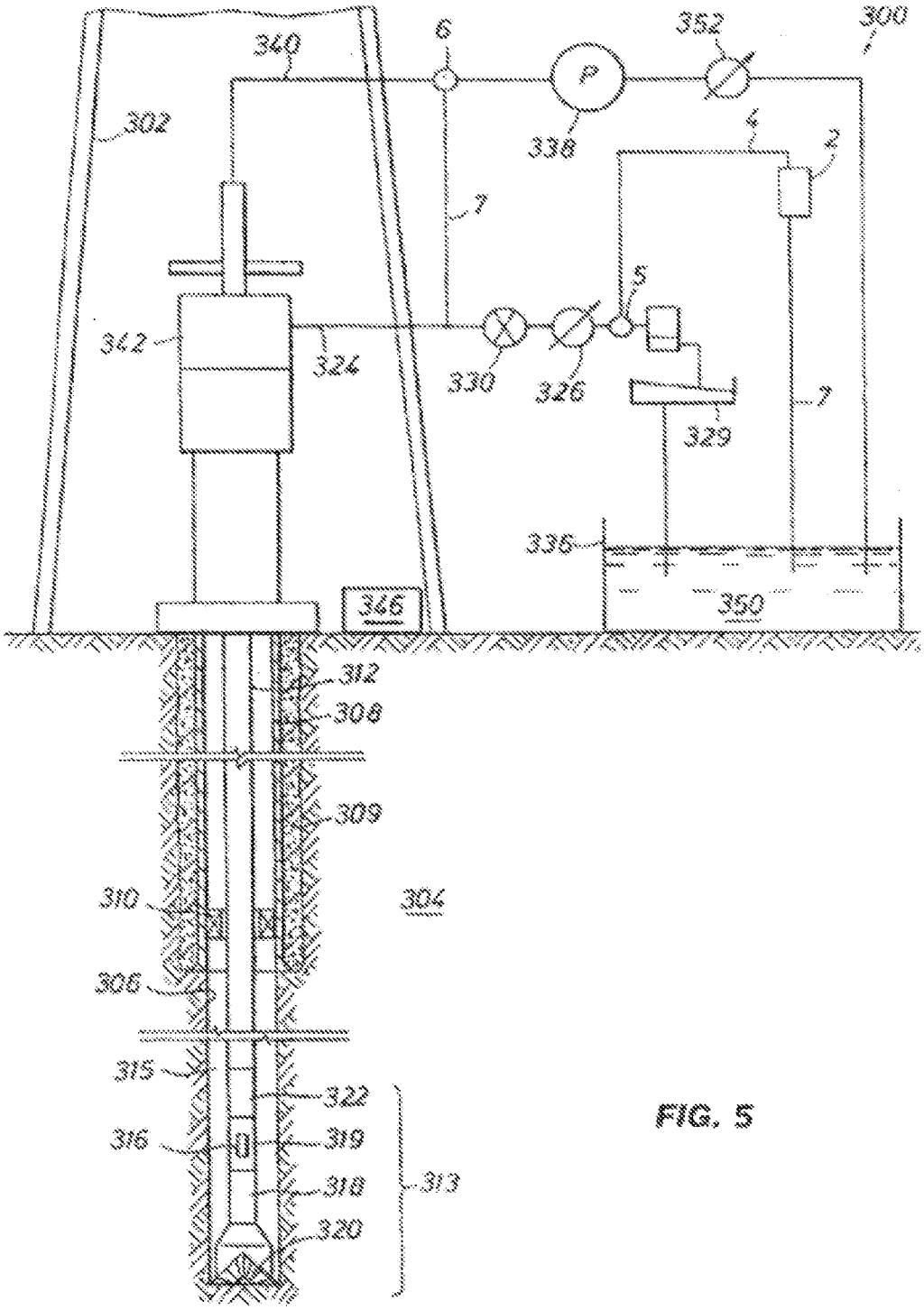

Another example of a MPD system that may be used with the system and/or method disclosed herein is shown in FIGS. 3-5. While 3-5 show a land based drilling system using a MPD system, it will be appreciated that an offshore drilling system may likewise use a MPD system. FIGS. 3-5 are intended to further explain and provide examples of MPD systems, and are not intended to limit the scope of such systems or the components actually used in any particular example of marine drilling, as explained above with reference to FIG. 2. FIG. 3 is a plan view depicting a surface drilling system using an example MPD system. The drilling system 300 is shown as being comprised of a drilling rig 302 that is used to support drilling operations. Many of the components used on a rig 302, such as a kelly, power tongs, slips, draw works and other equipment are not shown for ease of depiction. The rig 302 is used to support drilling and exploration operations in formation 304. As depicted in FIG. 4 the borehole 306 has already been partially drilled, casing 308 set and cemented 309 into place. In the preferred embodiment, a casing shutoff mechanism, or downhole deployment valve, 310 is installed in the casing 308 to optionally shutoff the annulus and effectively act as a valve to shut off the open hole section when the bit is located above the valve.

The drill string 312 supports a bottom hole assembly (BHA) 313 that includes a drill bit 320, a mud motor 318, a MWD/LWD sensor suite 319, including a pressure transducer 316 to determine the annular pressure, a check valve, to prevent backflow of fluid from the annulus. The BHA also includes a telemetry package 322 that is used to transmit pressure, MWD/LWD as well as drilling information to be received at the surface. While FIG. 3 illustrates a BHA utilizing a mud telemetry system, it will be appreciated that other telemetry systems, such as radio frequency (RF), electromagnetic (EM) or drilling string transmission systems may be used.

As noted above, the drilling process requires the use of a drilling fluid 350, which is stored in reservoir 336. The reservoir 336 is in fluid communications with one or more mud pumps 338 which pump the drilling fluid 350 through conduit 340. The conduit 340 is connected to the last joint of the drill string 312 that passes through a rotating or spherical BOP 342. A rotating BOP 342, when activated, forces spherical shaped elastomeric elements to rotate upwardly, closing around the drill string 312, isolating the pressure, but still permitting drill string rotation. Commercially available spherical BOPs, such as those manufactured by Varco International, are capable of isolating annular pressures up to 10,000 psi (68947.6 kPa). The fluid 350 is pumped down through the drill string 312 and the BHA 313 and exits the drill bit 320, where it circulates the cuttings away from the bit 320 and returns them up the open hole annulus 315 and then the annulus formed between the casing 308 and the drill string 312. The fluid 350 returns to the surface and goes through diverter 317, through conduit 324 and various surge tanks and telemetry systems (not shown).

Thereafter the fluid 350 proceeds to what is generally referred to as the backpressure system 331. The fluid 350 enters the backpressure system 331 and flows through a flow meter 326. The flow meter 326 may be a mass-balance type or other high-resolution flow meter. Using the flow meter 326, an operator will be able to determine how much fluid 350 has been pumped into the well through drill string 312 and the amount of fluid 350 returning from the well. Based on differences in the amount of fluid 350 pumped versus fluid 350 returned, the operator is be able to determine whether fluid 350 is being lost to the formation 304, which may indicate that formation fracturing has occurred, i.e., a significant negative fluid differential. Likewise, a significant positive differential would be indicative of formation fluid entering into the well bore.

The fluid 350 proceeds to a wear resistant choke 330. It will be appreciated that there exist chokes designed to operate in an environment where the drilling fluid 350 contains substantial drill cuttings and other solids. Choke 330 is one such type and is further capable of operating at variable pressures and through multiple duty cycles. The fluid 350 exits the choke 330 and flows through valve 321. The fluid 350 is then processed by an optional degasser and by a series of filters and shaker table 329, designed to remove contaminates, including cuttings, from the fluid 350. The fluid 350 is then returned to reservoir 336. A flow loop 319A is provided in advance of valve 325 for feeding fluid 350 directly a backpressure pump 328. Alternatively, the backpressure pump 328 may be provided with fluid from the reservoir through conduit 319B, which is in fluid communication with the reservoir 336 (trip tank). The trip tank is normally used on a rig to monitor fluid gains and losses during tripping operations. A three-way valve 325 may be used to select loop 319A, conduit 319B or isolate the backpressure system. While backpressure pump 328 is capable of using returned fluid to create a backpressure by selection of flow loop 319A, it will be appreciated that the returned fluid could have contaminates that have not been removed by filter/shaker table 329. As such, the wear on backpressure pump 328 may be increased. As such, a backpressure may be created using conduit 319B to provide reconditioned fluid to backpressure pump 328.

In operation, valve 325 would select either conduit 319A or conduit 319B, and the backpressure pump 328 engaged to ensure sufficient flow passes the choke system to be able to maintain backpressure, even when there is no flow coming from the annulus 315. The backpressure pump 328 may be capable of providing up to approximately 2200 psi (15168.5 kPa) of backpressure; though higher pressure capability pumps may be selected.

The pressure in the annulus provided by the fluid is a function of its density and the true vertical depth and is generally a by approximation linear function. As noted above, additives added to the fluid in reservoir 336 are pumped downhole to eventually change the pressure gradient applied by the fluid 350.

A flow meter 352 may be disposed in conduit 300 to measure the amount of fluid being pumped downhole. It will be appreciated that by monitoring flow meters 326, 352 and the volume pumped by the backpressure pump 328, the system is readily able to determine the amount of fluid 350 being lost to the formation, or conversely, the amount of formation fluid leaking to the borehole 306.

An MPD system as describe with reference to FIGS. 3-5 may also be used to monitor well pressure conditions and predict borehole 306 and annulus 315 pressure characteristics.

FIG. 5 depicts another example MPD system in which a backpressure pump is not required to maintain sufficient flow through the choke system when the flow through the well needs to be shut off for any reason. In this example, an additional three way valve 6 is placed downstream of the rig pump 338 in conduit 340. This valve allows fluid from the rig pumps to be completely diverted from conduit 340 to conduit 7, not allowing flow from the rig pump 338 to enter the drill string 312. By maintaining pump action of pump 338, sufficient flow through the manifold to control backpressure may be ensured.

To control a well event, a BOP may be closed in the event of a large formation fluid influx, such as a gas kick, to effectively to shut in the well, relieve pressure through the choke and kill manifold, and weight up the drilling fluid to provide additional annular pressure. An alternative method is sometimes called the "Driller's" method, which uses continuous circulation without shutting in the well. A supply of heavily weighted fluid, e.g., 18 pounds per gallon (ppg) (3.157 kg/l) is constantly available during drilling operations below any set casing. When a gas kick or formation fluid influx is detected, the heavily weighted fluid is added and circulated downhole, causing the influx fluid to go into solution with the circulating fluid. The influx fluid starts coming out of solution upon reaching the casing shoe and is released through the choke manifold. It will be appreciated that while the Driller's method provides for continuous circulation of fluid, it may still require additional circulation time without drilling ahead, to prevent additional formation fluid influx and to permit the formation fluid to go into circulation with the now higher density drilling fluid.

MPD systems and methods of pressure control may also be used to control a major well event, such as a fluid influx. Using MPD systems and methods when a formation fluid influx is detected, the backpressure is increased, as opposed to adding heavily weighted fluid. Like the Driller's method, the circulation is continued. With the increase in pressure, the formation fluid influx goes into solution in the circulating fluid and is released via the choke manifold. Because the pressure has been increased, it is no longer necessary to immediately circulate a heavily weighted fluid. Moreover, since the backpressure is applied directly to the annulus, it quickly forces the formation fluid to go into solution, as opposed to waiting until the heavily weighted fluid is circulated into the annulus.

MPD systems and methods may also be used in non-continuous circulating systems. As noted above, continuous circulation systems are used to help stabilize the formation, avoiding sudden pressure drops that occur when the mud pumps are turned off to make/break new pipe connections. This pressure drop is subsequently followed by a pressure spike when the pumps are turned back on for drilling operations. These variations in annular pressure can adversely affect the borehole mud cake, and can result in fluid invasion into the formation. Backpressure may be applied to the annulus using a MPD system upon shutting off the mud pumps, ameliorating the sudden drop in annulus pressure from pump off condition to a more mild pressure drop. Prior to turning the pumps on, the backpressure may be reduced such that the pump additional spikes are likewise reduced.

The gas lift system shown in FIG. 2 may require a relatively small amount of equipment to be deployed below the water surface 2 (e.g., the connection to the return line 138 and the pressure sensor 28). Such equipment is proven to operate at water depths of up to several thousand feet for extended periods of time. Because most of the equipment may be operated at the surface, for example the compressor, a failure of such equipment may be significantly less costly to replace, because the equipment is readily accessible. Additional compressors can also be added to the system without substantial effort.

A system in accordance with embodiments disclosed herein, such as the one shown in FIG. 2, does not require any seal to isolate the marine riser fluid from the fluid in the wellbore. Specifically, because the gas injected into the return line may be readily removable from the riser fluid and/or wellbore fluid (e.g., by venting to atmosphere), separation of the riser fluid and the wellbore fluid is not necessary. Further still, the system as shown in FIG. 2 may be used with a standard cuttings processing system provided by ordinary marine drilling equipment.

The system and method disclosed herein may allow wellbore pressure to be precisely and immediately controlled. The pressure and volume of fluid in the return line may be reduced while the one or more rig pumps are switched off, because the return line can be evacuated by continuing to pump air or gas into the return line (138 in FIG. 2). Thus, when the one or more rig pumps are turned back on, the choke (30 in FIG) may be opened and the riser fluid rapidly evacuated into the fluid return line, which may occur in only a few minutes. A gas lift system as described herein may have a small footprint, thereby permitting installation on any rig with a reasonable amount of deck space or possible deployment from another vessel. Finally, the system and method disclosed herein tend to have reduced formation gas fractions (e.g., hydrocarbon gases) in the returned drilling fluid. By pumping inert gas or air into the fluid return line, the formation gas fraction may be maintained below the lower explosive limit (LEL) of methane, which is approximately 5%. Thus, the system and method disclosed herein may provide a higher level of safety.

The embodiments described herein are to be construed as illustrative and not as constraining the remainder of the disclosure in any way whatsoever. While the embodiments have been shown and described, many variations and modifications thereof can be made by one skilled in the art without departing from the scope and teachings disclosed herein. Accordingly, the scope of protection is not limited by the description set out above, but is only limited by the claims, including all equivalents of the subject matter of the claims. The disclosures of all patents, patent applications and publications cited herein are hereby incorporated herein by reference, to the extent that they provide procedural or other details consistent with and supplementary to those set forth herein.

What is claimed is:

1. A system comprising:

a drill string extending into a wellbore below a bottom of a body of water;

a primary pump for selectively pumping a drilling fluid through the drill string and into an annular space created between the drill string and the wellbore;

a riser extending from a top of the wellbore to a platform on a surface of the body of water;

a fluid discharge conduit in fluid communication with the riser;

a controllable orifice choke coupled to the discharge conduit;

a fluid return line extending from the choke to the platform;

a source of compressed gas coupled to the fluid return line at a selected depth below the surface of the body of water;

a separator coupled to the fluid return line;

a flow meter coupled to a gas discharge end of the separator; and a controller configured to receive an input signal from the flow meter and configured to compare a flow rate of gas measured by the flow meter to a flow rate of gas pumped into the fluid return line.

2. The system of claim 1, further comprising a pressure sensor disposed at a selected depth in the wellbore or the riser.

3. The system of claim 2, wherein the controller is configured to accept an input signal from the pressure sensor and configured to generate an output signal to operate the choke, wherein the choke is operated to maintain a selected hydrostatic pressure in the riser at a selected distance below the surface of the body of water.

4. The system of claim 3, further comprising at least one fluid flow meter for measuring a flow of fluid into the wellbore or out of the wellbore, and wherein the controller accepts an input signal from the at least one fluid flow meter, the controller generating an output signal to operate the choke to maintain fluid pressure in the wellbore at a selected value.

5. The system of claim 1, wherein the controllable orifice choke is disposed at a selected depth below the surface of the body of water.

6. The system of claim 1, further comprising a pressure sensor coupled to the fluid return line.

7. The system of claim 1, wherein the fluid return line extending from the choke to the platform includes a vertical portion disposed below the surface of the body of water.

8. The system of claim 1, further comprising a check valve coupled to the fluid return line between the controllable orifice choke and an inlet in the fluid return line coupled to the source of compressed gas.

9. The system of claim 1, wherein the pressure sensor is coupled to the discharge conduit proximate the fluid choke.

10. A method comprising:

pumping drilling fluid through a drill string extended into a wellbore extending below a bottom of a body of water, out the bottom of the drill string, and into the wellbore annulus;

discharging fluid from the wellbore annulus and into a riser disposed above the top of the wellbore, the riser extending to the surface of the body of water, discharging fluid from the riser through a fluid return line, the fluid return line extending from below the surface of the body of water to the surface of the body of water;

pumping gas under pressure into the return line at a selected depth below the surface of the body of water;

maintaining a selected hydrostatic pressure in the riser at a selected distance below the surface of the body of water;

separating the gas from a fluid returned by the return line proximate the surface of the body of water;

measuring a flow rate of the gas separated from the fluid returned by the return line; and comparing the flow rate of the gas separated from the fluid returned by the return line to a flow rate of the gas pumped into the return line.

11. The method of claim 10, further comprising measuring a pressure of fluid in the riser at a selected depth, and operating a controllable fluid choke disposed between the riser and the fluid return line based on the measuring to maintain the selected hydrostatic pressure in the riser at the selected distance below the surface of the body of water.

12. The method of claim 10, further comprising adjusting the hydrostatic pressure in the riser by adjusting a flow rate of gas pumped into the return line.

13. A method comprising:

pumping drilling fluid through a drill string extended into a wellbore extending below the bottom of a body of water, out the bottom of the drill string, and into the wellbore annulus;

discharging fluid from the wellbore annulus into a riser disposed above the top of the wellbore and into a discharge conduit, the discharge conduit including a fluid choke and a fluid return line coupled to an outlet of the fluid choke and extending to the water surface;

pumping gas under pressure into the return line at a selected depth below the water surface;

controlling a rate at which the gas is pumped into the return line and operating a back pressure pump to apply back pressure to the discharge conduit to maintain a level of fluid in the riser at a selected distance below the surface of the body of water;

wherein a controller receives input signals from at least one of a pressure sensor in the discharge conduit, a first flow meter coupled to a liquid discharge end of a separator configured to separate the gas from the fluid in the return line, and a second flow meter coupled to a gas discharge end of the separator, and wherein the controller sends output signals to operate the fluid choke and the back pressure pump to maintain the level of fluid in the riser at the selected distance below the surface of the body of water.

14. The method of claim 13, further comprising operating the fluid choke in response to a measured flow rate in the discharge conduit proximate the fluid choke.

15. The method of claim 13, further comprising restricting fluid flow from the return line to the fluid choke.

16. The method of claim 13, further comprising venting gas from the return line to atmosphere.

17. The method of claim 13, wherein the controlling the rate at which the gas is pumped into the return line comprises comparing the rate at which the gas is pumped into the return line to a rate at which drilling fluid is pumped through the drill string.

* * * * *